United States Patent [19]

Schilling

[11] 4,261,242

[45] Apr. 14, 1981

[54] ARRANGEMENT FOR CHROMATIC AND DIATONIC KEYS FOR CARILLON KEYBOARDS

[75] Inventor: F. Peter Schilling, Apolda, German Democratic Rep.

[73] Assignee: Veb Ingenieurbuero und Mechanisierung, Gotha, German Democratic Rep.

[21] Appl. No.: 54,601

[22] Filed: Jul. 3, 1979

[51] Int. Cl.[3] ..... G10C 3/14

[52] U.S. Cl. ..... 84/423 R; 84/353

[58] Field of Search ..... 84/353, 366, 423, 426, 84/444, DIG. 25

[56] References Cited

U.S. PATENT DOCUMENTS

| | | | |
|---|---|---|---|
| 2,480,132 | 8/1949 | Hammond et al. | 84/1.24 |
| 3,585,893 | 6/1971 | Arseneault | 84/1.17 |
| 3,962,945 | 6/1976 | Creager et al. | 84/1.01 |

*Primary Examiner*—Lawrence R. Franklin
*Attorney, Agent, or Firm*—Michael J. Striker

[57] ABSTRACT

An arrangement for chromatic and diatonic keys for a carillon keyboard is provided. A guide plate has key receiving slots located such that the natural, or diatonic, keys are in a lower row and the accidental, or chromatic, keys are in an upper row, the chromatic keys being placed between the diatonic keys. The pivots for the keys are staggered axially of the keys with the diatonic key pivots being behind the chromatic key pivots. The carillon actuating wires are connected to the keys in a staggered relationship, also, with the diatonic key wires being connected forwardly of the chromatic key wires. This arrangement provides a balance of force for all of the keys.

4 Claims, 2 Drawing Figures

ARRANGEMENT FOR CHROMATIC AND DIATONIC KEYS FOR CARILLON KEYBOARDS

BACKGROUND OF THE INVENTION

Field of application of the invention

This invention relates to a device for guiding and the arrangement of keys and pedals on carillon keyboards and practice keyboards.

With all carillon keyboards known, the planes of the guides of chromatic and diatonic keys are horizontally divided. By this, a relatively large difference in height between the chromatic and diatonic keys can be noted.

Carillon keyboards are known where the guide of the two rows of keys consists of two wooden frames, one arranged over the other.

The large difference of height between the chromatic and diatonic keys brings about an unfavorable influence upon the mode of playing of the carillonneur.

Furthermore with the carillon keyboards known, the guide slots for chromatic and diatonic keys are made with the same length, whereby travel limits of equal dimensions will result for chromatic and diatonic keys.

All known technical solutions have the common disadvantage that unequal forces are required for the sounding of neighboring tones and that the travels at the free end of the keys are of unequal dimensions.

SUMMARY OF THE INVENTION

It is an object of this invention to provide an optimal design of the carillon keyboard by the creation of a balance of force at all neighboring keys and pedals and by reducing the difference in height between the chromatic and diatonic keys, thus enabling manual play with virtuosity at a minimum expenditure of force. These and the other affects are achieved by means of slotted guide-plates, wherein the guide slots are arranged horizontally in two rows which vertically overlap each other.

A further feature of the invention consists in horizontally staggering the pivotal points at the end of the keys and the wire connection points of the chromatic tones relative to the keys of the diatonic tones, so that the directions of the stagger of the pivotal points and of the points of the wire connection are running in opposite directions.

DETAILED DESCRIPTION OF THE INVENTION

Figure 1:
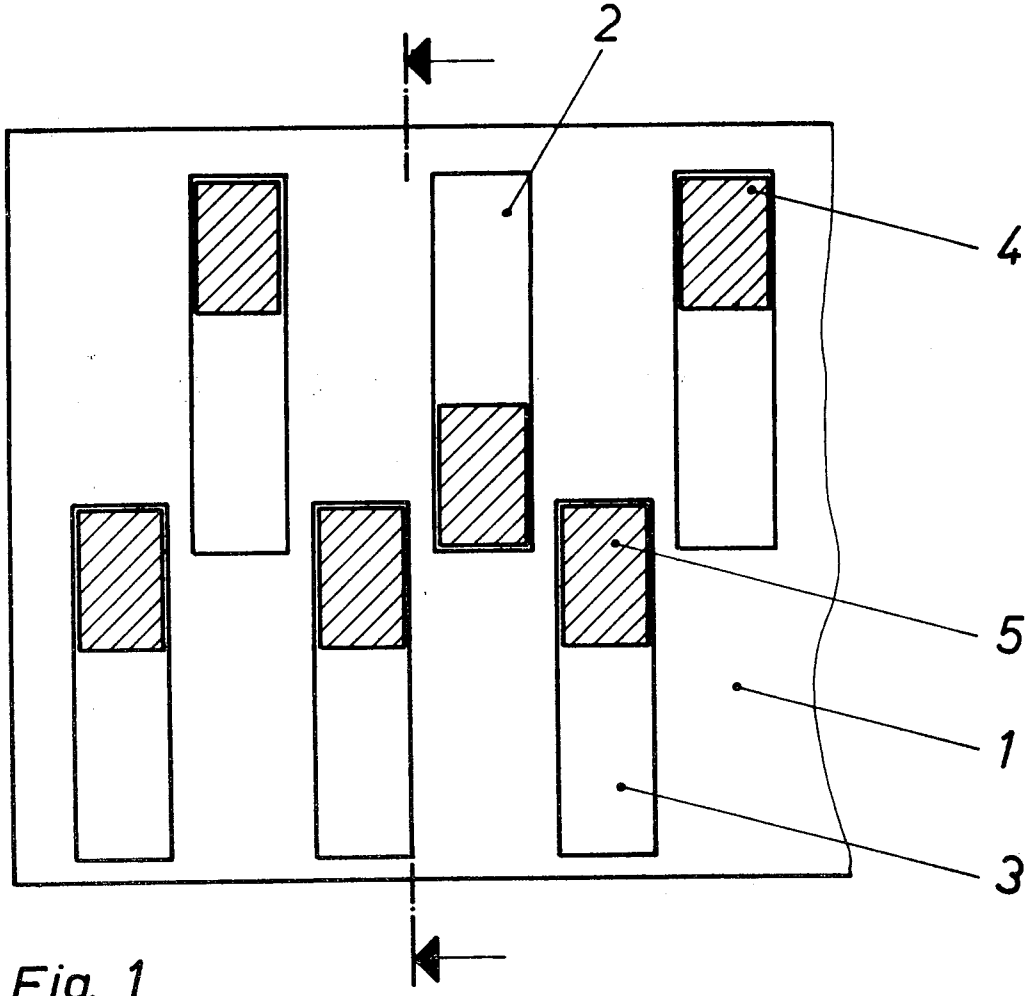
FIG. 1 shows a front view of the guide plate with chromatic and diatonic keys of the preferred embodiment in accordance with the invention

Referring now to FIG. 1, a guiding arrangement of the carrilon keyboard includes a guide plate 1. Guide slots 2 for the chromatic keys 4 and guide slots 3 for the diatonic keys 5 are formed in the guide plate 1 in two horizontal tiers. The two tiers of guide slots 2, 3 are overlapping relationship to each other in the vertical direction. This design will result in a substantial reduction in the difference of height between chromatic keys 4 and diatonic keys 5.

The guide slots 2 for the chromatic keys 4 are longer than the guide slots 3 for the diatonic keys 5. This results in a favorable influence upon the balance of forces between neighboring chromatic and diatonic keys.

As can be seen in FIG. 1, the lower travel limitation of the chromatic keys 4 will be between and below the upper travel limitation of the diatonic keys which will result in a considerable reduction of the difference in the height between the chromatic and diatonic keys. The longer guide slots of the chromatic keys have a favorable effect upon the balancing of forces between the neighboring chromatic and diatonic keys.

Figure 2:
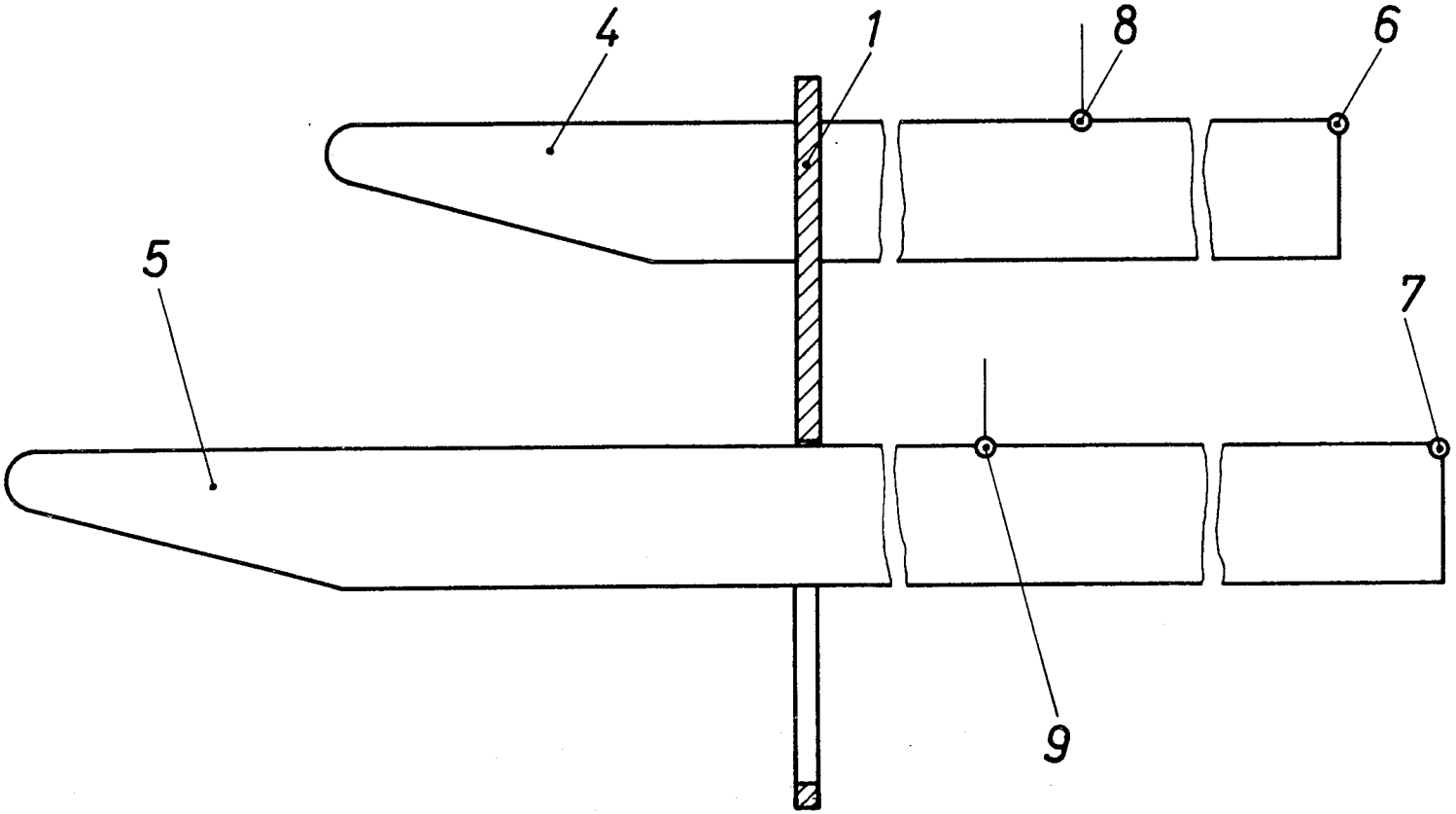
FIG. 2 is an elevational section view of the device shown in FIG. 1.

FIG. 2 shows a side elevational view illustrating the positions of the chromatic and diatonic keys in the keyboard. Chromatic keys 4 which are located at the upper level of the guide plate 1 include pivoting points 6 to pivotally connect the keys with a frame of the keyboard (not shown). Diatonic keys 5 are disposed in the slots 3 formed in the lower level of the guide plate and are pivotally connected to the keyboard frame at the pivotal points 7. Chromatic keys 4 have wire connection points 8 and diatonic keys 5 have wire connection points 9.

The pivotal points 6 and the wire connecting points 8 for the chromatic keys 4 are horizontally staggered relative to the pivotal points 7 and the wire connecting points 9 for the diatonic keys 5. The direction of staggering of the pivotal points 6, 7 and of the wire connecting points 8, 9 are running in opposite directions. By this, a balance of forces is achieved at the free end of the keys 4 and 5 and at the wire connecting points 8, 9 of neighboring diatonic tones. Furthermore, equal travels are obtained at the free end of the keys 4, 5 and the wire connecting points 8, 9.

By application of the lever principle in distribution of the forces acting on the keys disposed on the different levels a balance of forces will be achieved at the free ends of the keys and at the wire connecting points. The advantage of the invention over the conventional technical solutions is an essential reduction of the difference in height between the chromatic and diatonic keys resulting in equal forces and travels at the free ends of the neighboring chromatic and diatonic keys thereby providing a substantial reduction in expenditure of forces and physical exertion of a carillonneur playing the carillon.

I claim:

1. An arrangement for chromatic and diatonic keys for carillon keyboards, comprising a guide plate for supporting the chromatic and diatonic keys, said guide plate being formed with a first row of elongated guide slots to receive the chromatic keys and a second row of elongated guide slots to receive the diatonic keys, said first and second rows of guide slots being axially extended on said guide plate so as the guide slots disposed in said first row are arranged in vertical overlapping position with the guide slots disposed in said second row thereby substantially reducing the difference in height between the chromatic and diatonic keys.

2. The arrangement as defined in claim 1, wherein said guide slots to receive the chromatic keys are relatively longer than said guide slots to receive the diatonic keys.

3. The arrangement of claim 1, wherein said chromatic keys include first pivots for pivotal movement said chromatic keys about said first pivots, and said diatonic keys include second pivots for pivotal movement said diatonic keys about said second pivots, said first pivots being staggered in the axial direction relatively to said second pivots.

4. The arrangement as defined in claim 1, wherein said chromatic keys include first wire connections and said diatonic keys include second wire connections, said first wire connections are staggered in the axial direction relatively to said second wire connections, the direction of staggering of said first and second pivots in running opposite to the direction of staggering of said first and second wire connections.

* * * * *